US005694890A

United States Patent [19]

Yazdi

[11] Patent Number: 5,694,890

[45] Date of Patent: Dec. 9, 1997

[54] INTERNAL COMBUSTION ENGINE WITH SLIDING VALVES

[76] Inventor: Kamran Yazdi, 4530 Alonzo Ave., Encino, Calif. 91316

[21] Appl. No.: 720,922

[22] Filed: Oct. 7, 1996

[51] Int. Cl.[6] ..... F01L 5/02

[52] U.S. Cl. ..... 123/58.9; 123/88; 123/188.4

[58] Field of Search ..... 123/188.1, 188.3, 123/188.4, 58.9, 81 R, 81 B, 88, 89

[56] References Cited

U.S. PATENT DOCUMENTS

| | | | |
|---|---|---|---|
| 1,922,678 | 8/1933 | Hallett | 123/188.4 |
| 2,028,138 | 1/1936 | Coulling | 123/188.4 |
| 2,409,350 | 10/1946 | Forrest | 123/188.4 |
| 2,741,931 | 4/1956 | Sills | 123/188.4 |
| 3,854,849 | 12/1974 | Brille | 418/61.3 |
| 4,465,040 | 8/1984 | Pelizzoni | 123/188.9 |
| 4,765,287 | 8/1988 | Taylor et al. | 123/188.4 |
| 4,872,430 | 10/1989 | Biagini | 123/188.4 |
| 4,875,440 | 10/1989 | Kaptur | 123/188.4 |
| 5,406,917 | 4/1995 | Rao et al. | 123/188.9 |

*Primary Examiner*—Erick R. Solis
*Attorney, Agent, or Firm*—Elliott N. Kramsky

[57] ABSTRACT

An internal combustion engine includes slidable valves. Horizontal valve seats of tapered design are associated with inlet and exhaust ports at the top of the engine's combustion chambers. The slidable valves are generally planar and tapered to conform to the valve seats. A rod is engaged to the rear of each valve and is spring-loaded. Movement of the slidable valves is effected through mechanical coupling of the rotation of the crankshaft to a rocker arm that is oriented substantially orthogonal to the rod whereby crankshaft rotation is translated into horizontal, sliding movements of the planar valves.

7 Claims, 3 Drawing Sheets

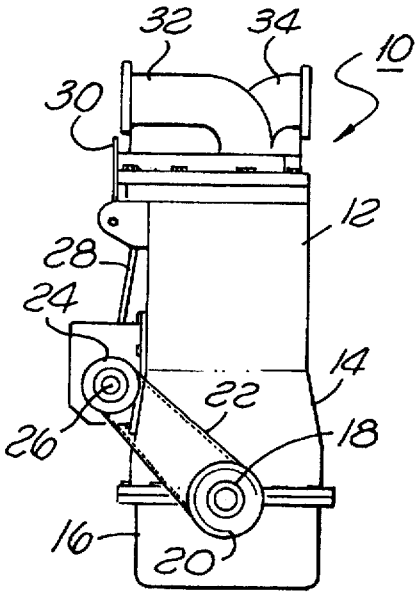
FIG. 1
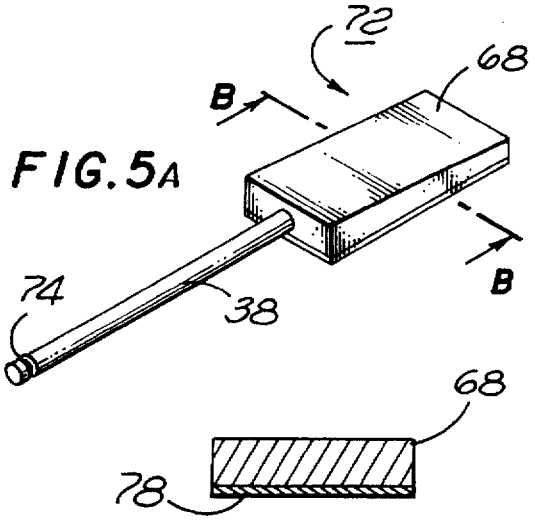
FIG. 5A
FIG. 5B
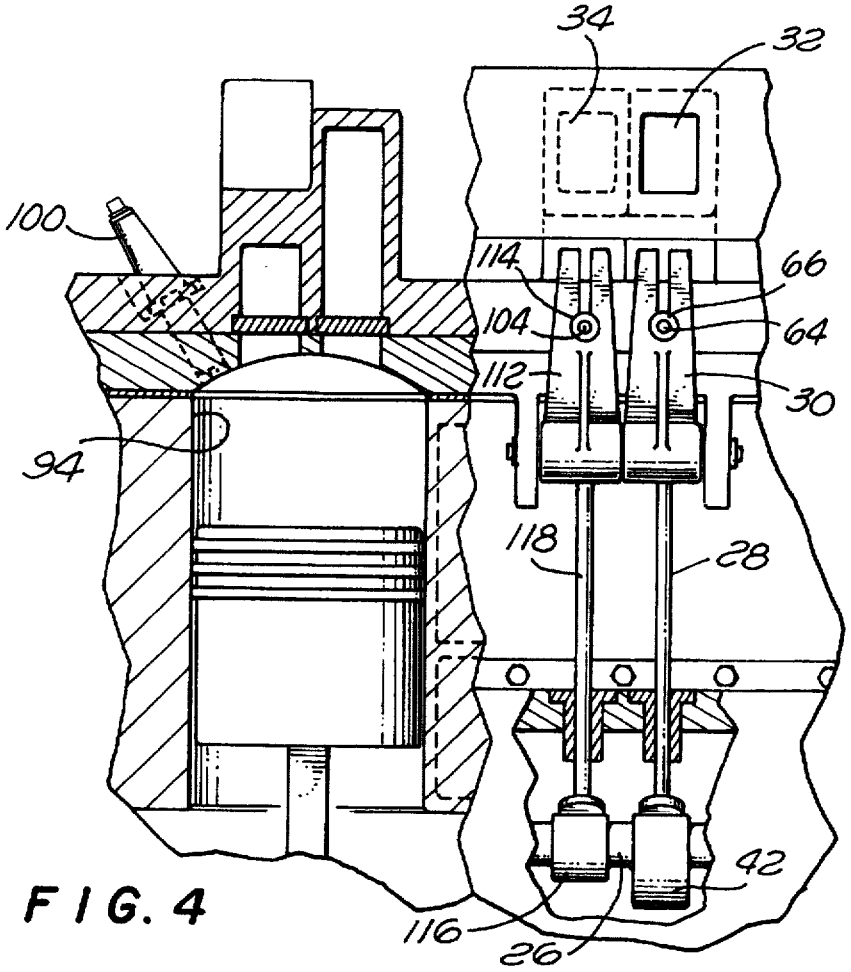
FIG. 4

INTERNAL COMBUSTION ENGINE WITH SLIDING VALVES

BACKGROUND

1. Field of the Invention

The present invention relates to internal combustion engines. More particularly, this invention pertains to an internal combustion engine that includes cylinder valves that are slidably actuable to control the flow of air with respect to the combustion chambers.

2. Description of the Prior Art

Among the most critical elements of an internal combustion engine are the valves that regulate the gas flows into and out of the combustion chambers. Each chamber houses a reciprocating piston. Thus, for example, an eight cylinder engine has eight pistons requiring the careful regulation of sixteen valves.

The output of the engine consists of rotation of a crankshaft. Such movement is distributed to the wheels by means of a differential engaged to an axle of the automobile. Rotation of the crankshaft is produced through successive, phased inputs of angular motion via connecting rods pivotally engaged at one end to pistons, and, at the other, to rod journals which are offset from the main journals that lie along the axis of rotation of the crankshaft. The application of successive, phased forces to the offset journals results in crankshaft rotation. The axis of rotation of the crankshaft is aligned with that of a drive shaft that can be engaged and disengaged from the crankshaft by means of a clutch. The output of the drive shaft is, in turn employed, to drive the wheels of the automobile through the differential.

Thus, the engine of an automobile translates the reciprocating motions of the pistons into rotation of a shaft. The generation of the reciprocating movements of the pistons is accomplished through the well-understood four-stroke process of internal combustion. The four elements of this process include an "induction stroke" during which a mixture of air and fuel is received at the top of the cylinder (i.e. above the piston) from a carburetor or fuel injectors. The piston travels downwardly (pulled by the rotating crankshaft via the connecting rod), creating a vacuum that sucks in the air-fuel mixture. After the induction stroke, the portion of the cylinder above the piston is sealed and a "compression stroke" begun during which the connecting rod pushes the piston upwardly, compressing the fuel-air mixture. Once the compression stroke has been completed, a high-voltage spark is emitted by a spark plug, igniting the fuel-air mixture within the sealed compression chamber. The resulting combustion of the mixture causes an expansion of gaseous volume, generating a force that acts downwardly upon the top of the piston. This drives down the piston to impart rotation to the crankshaft. The amount of angular motion imparted is dependent upon the number of engine cylinders. Once this motion (the "downstroke") has been completed, the gases within the combustion chamber are vented and the piston is again driven upwardly within the cylinder by the rotation of the crankshaft. Another four-stroke cycle may then begin. At a typical freeway engine speed of 2200 r.p.m., the entire four-stroke process is completed at a rate of eighteen times per second in each cylinder.

As can be seen from the above, during different periods of time of each cycle of operation of an internal combustion engine the combustion chamber above the piston must be sealed, then opened. More particularly, each cylinder of an internal combustion engine must include means for (1) regulating an inlet flow of an air-fuel mixture, (2) permitting an outlet flow of combustion gases and (3) providing a reliable seal during the compression and power strokes. This is accomplished by providing intake and exhaust ports that communicate with the portion of the cylinder that lies above top dead center of the piston. An intake and an exhaust valve seal the two ports respectively. The motions of the two valves are derived from the crankshaft of the engine through various linkages.

The valves that control the flow of the intake and exhaust gases in most engines are of the poppet type which move up and down to open and close the respective ports. Such valves include elongated stems and terminate in generally-circular broadened heads. The heads include angled faces that are cut to match the angle formed by the valve seat. The valve seats and poppet-type valves interact whereby the combustion chamber is sealed by drawing the valves upwardly (stems protruding from the cylinder) until the enlarged heads abut the valve seats adjacent the top of the cylinder. A seal is formed between the circumferential faces of the valves and the circular valve seats. Conversely, the valves admit gas flows when driven downwardly so that the faces disengage from the valve seats.

Engine performance is critically dependent upon the reliability and quality of the valving operation described above. Unfortunately, the very design of poppet-type valves inherently hinders the efficiency of operation. The enlarged sealing heads of both intake and exhaust valves and the fact that such valves extend into the cylinder provides a resistance to flows of both the combustion mixture and exhaust gases that effectively reduces the amount of time during the four-stroke sequence devoted to the critical compression and power strokes. As a result, the efficiency of the engine is reduced, the amount of unburned air-fuel mixture increased (thereby creating pollution due to the presence of particulates resulting from unburned fuel) and the like. Further, the valves are subject to extreme operating temperatures resulting from their repeated projections into the combustion chamber. The intake valves are cooled by the incoming air-fuel mixture but the exhaust valves are only cooled by contact with the engine head. Some heat is transferred from the face of the valve to the valve seat when the valve is closed, but the majority of the heat is dissipated through the thin valve stem as it passes through the valve guide in the head. It is common for the exhaust valves to reach temperatures between 1,000 and 1,400 degrees Fahrenheit and to glow red during operation. Such heating also poses problems for proper sealing as the seat and the valve will expand differently as temperatures increase.

SUMMARY OF THE INVENTION

The present invention addresses the foregoing and other shortcomings of the prior art by providing an improvement in an internal combustion engine of the type in which a plurality of pistons reciprocate within a plurality of cylinders over a repeating four-stroke cycle. Each of the cylinders includes an inlet port for admitting an air-fuel mixture during an intake stage and an exhaust port for evacuating combustion gases during an exhaust stage. Valves control flows through each of the ports. The reciprocating motions of the pistons drive a rotatable crankshaft.

The improvement provided by the invention includes external valve seats associated with the intake and exhaust ports of each cylinder. Means are provided, responsive to rotation of the crankshaft and engaged to each of the valves, for slidingly moving the valves into and out of the valve seats.

The preceding and other features and advantages of this invention will become further apparent from the detailed description that follows. Such description is made with reference to a set of drawing figures. Numerals of the drawing figures, correspond to those of the written description, point to the various features of the invention. Like numerals refer to like features throughout both the written description and the drawing figures.

BRIEF DESCRIPTION OF THE DRAWINGS

FIG. 1 is a front elevation view of an internal combustion engine including the valve operating mechanism of the invention;

FIG. 4 is a view taken generally on line 4—4 of FIG. 3 partly in section;

FIGS. 5(*a*) and 5(*b*) are a perspective view of a slidable valve in accordance with the invention and a cross section thereof taken at line 5(*a*)—5(*a*) and 5(*b*)—5(*b*) of FIG. 5(*a*) respectively.

DETAILED DESCRIPTION OF THE PREFERRED IMBODIMENT

Figure 2:
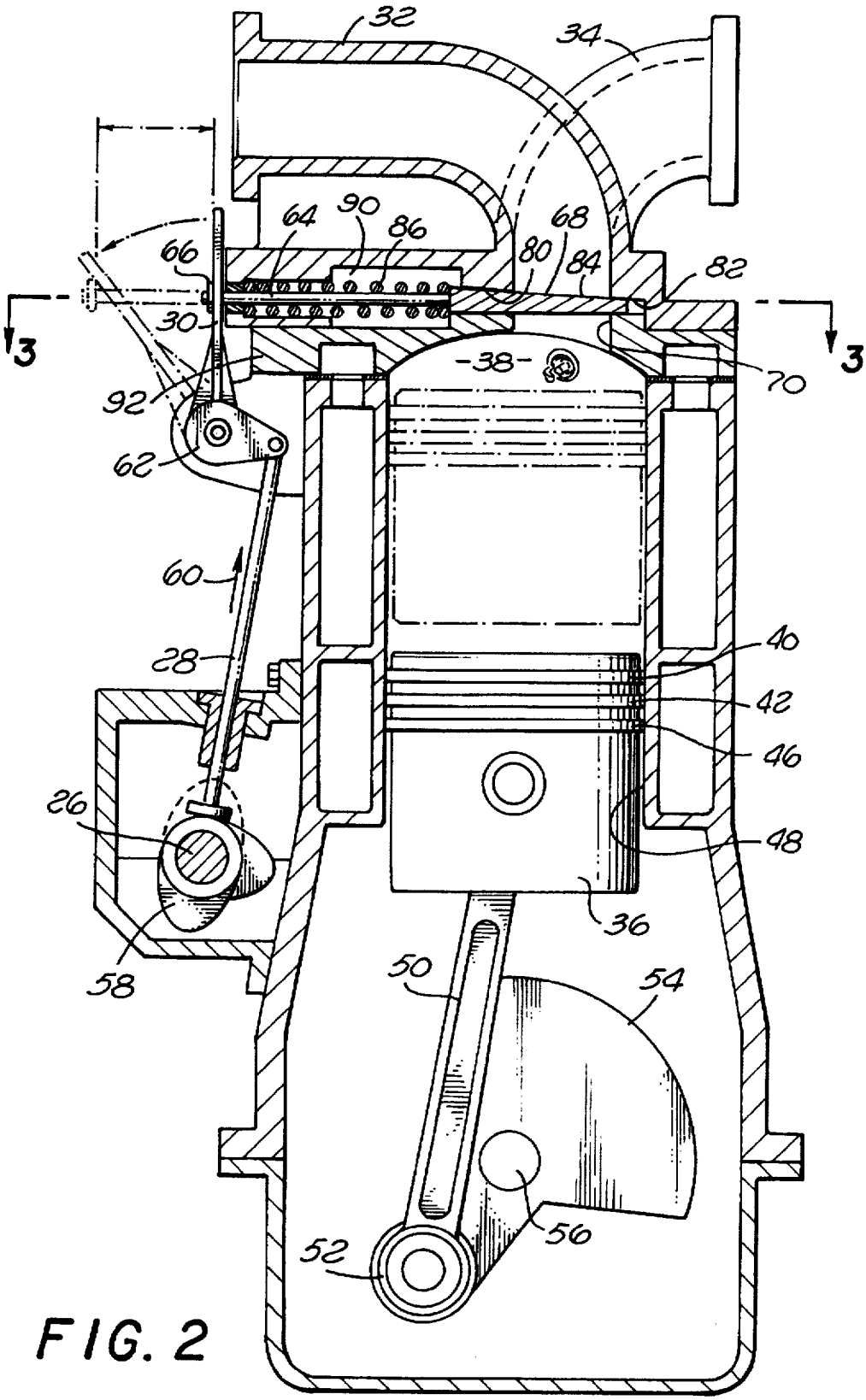
FIG. 2 is a view generally taken on line 2—2 of FIG. 1 partially in section.

FIG. 1 is a front elevation view of an internal combustion engine 10 that includes sliding valves and associated valve-operating mechanisms in accordance with the invention. The engine 10 is based upon the modification of existing internal combustion engines, incorporating the principles of operation of such engines. Accordingly, many of the components and operations of the engine 10 are common and readily appreciated by those with knowledge of existing internal combustion engine technology.

The engine block 10 includes a combustion chamber 12 that houses the cylinders within which pistons reciprocate. Beneath the cylinders is an engine wall 14 and an oil pan 16 that are bolted to one another. The engine block 10 and the oil pan 16 house a crankshaft 18. Output rotation of the crankshaft 18 is transferred, by means of a crankshaft pulley 20 and a timing belt 22, to a camshaft pulley 24 that, in turn, drives a camshaft 26. The camshaft operates a push rod 28 that is linked to, and causes movement of, a rocker arm 30 engaged to the rod-like rear section of a sliding intake valve (not shown in FIG. 1). The vertical position of the rocker arm 30 corresponds to closure of the intake port. (A similar rocker arm is coupled to and actuated by another push rod that is engaged to the camshaft 26 for opening and closure of the exhaust port of the engine.) The arrangement of the rocker arm 30 is such that the valve-actuating mechanism is of the "puller" type. It will be readily apparent from the description that follows that the valve-operating mechanism of the invention might just as well be a "pusher" arrangement.

An intake port 32 provides a path between an intake manifold (not illustrated) and the interior of a cylinder while an exhaust port 34 provides a path between an exhaust manifold (not illustrated) and the interior of a cylinder. Both an intake port and an exhaust port are associated with each cylinder of the engine 10, requiring both an intake valve and an exhaust valve of the sliding type for regulating the flows of combustion and exhaust gases into and out of the cylinder during appropriate stages of the four-stroke cycle.

FIG. 2 is a vertical section taken of any one of the in-line cylinders of the engine 10. A piston 36 is shown to reciprocate within an associated cylinder 38. Rings 40, 42 and 46 effectively enlarge the diameter of the piston 36 with the upper pair 40 and 42 providing a compression seal against a cylinder wall 48 while the lower ring 42 seals the cylinder from the oil that surrounds the crankshaft. The piston 36 reciprocates during operation within the cylinder 38 with its so-called top dead center position shown in shadow outline. It can be determined from the near-vertical position of a piston rod 50 that is pivotally fixed to the piston 36 that the other position illustrated is near, but not at, bottom dead center.

The lower end of the piston rod 50 is pivotally engaged to a rod journal 52 that forms part of the crankshaft. The journal 52 is mounted to a counterweight 54 that rotates about a main journal bearing 56 which is aligned with the axis of rotation of the crankshaft. The counterweight provides momentum for driving the piston rod 50 upwardly during the exhaust stroke of the engine's Otto cycle.

As described earlier and illustrated in FIG. 1, rotation of the crankshaft 18 is transmitted to the camshaft 26 by means of a timing belt 22. A cam lobe 58 fixed to the camshaft 26 is arranged to urge the push rod 28 upwardly as indicated by the arrow 60 when rotated with the camshaft 26 to the position indicated by dashed lines. The upper end of the push rod 28 is pivoted to the base 62 of the rocker arm 30, discussed above. The rocker arm 30 is fixed at its upper end to a valve rod 64 by means of a fastener 66. The valve rod 64 forms the rear portion of an intake valve and is fixed at the opposed end to a substantially planar, slidable valve head 68. The intake valve regulates the flow of the mixture of combustion gases into the cylinder combustion chamber 38 by selectively shuttering an aperture 70 at the upper end thereof. Referring for a moment to FIG. 5(*a*), a perspective view of a complete slidable valve 72 in accordance with the invention, it is seen that the two-part structure includes the valve rod 38 having a notch 74 to receive the fastener 40. The valve head 68 is generally-rectangular along a cross section taken at line 5(*b*)—5(*b*) as illustrated in FIG. 5(*b*). The head 68 is preferably formed of a metallic alloy with its bottom face optionally coated with a layer 78 of appropriate low coefficient of friction material such as graphite, TEFLON or a composite of, for example, graphite and titanium.

Referring again to FIG. 2, a valve seat for slidably receiving the valve head 68 comprises tapered horizontal apertures 80 and 82 for receiving the correspondingly-tapered upper surface 84 of the valve head 68. Unlike common poppet-type valves that only seal over a predetermined circumference where valve and valve seat mesh, the head 68 of a slidable valve in accordance with the present invention, when seated, seals the relatively broad area over which intimate contact is maintained between the planar, tapered surfaces of the horizontal valve seat and the matchingly-tapered planar surfaces of the valve.

A spring 86 biases the valve head 68 toward closure of the inlet port 32. The spring 86 is seated between the rear edge of the valve head 68 and a spring seal 88 at the rear of a chamber 90 formed between the upper surface of a head piece 92 and the edge of the inlet port 32. As can be seen, the upper surface of the head piece 92 and the lower surface of the otherwise-conventional inlet port 32 are machined to form the chamber 90.

The inlet valve head 68 is illustrated in its closed position in FIG. 2, biased by the spring 86 to closure of the inlet port 32. This is appropriate for the compression, power and exhaust strokes of a four-stroke engine. The inlet port 32 is opened by sliding the valve head 68 leftward to open the aperture 70. The attitude of the rocker arm 30 for affecting opening of the aperture 70 is indicated in shadow outline. Leftward movement of the valve rod 64, also in shadow outline, is seen to follow counterclockwise rotation of the rocker arm 30. Such rotation is, as mentioned earlier, responsive to upward movement of the push rod 28 as the cam lobe 58 is rotated by the camshaft 26 to the position indicated by dashed outline.

Once the intake stroke is completed, the lower end of the push rod 28 will again contact the non-cammed portion of the camshaft 26 and follow the surface thereof downwardly, rotating the rocker arm 30 to the vertical position. Clockwise movement of the rocker arm 30, coupled with the bias provided by the spring 86, will move the valve head 68 to the right until seated within the tapered segments 80 and 82 of the valve seat.

Figure 3:
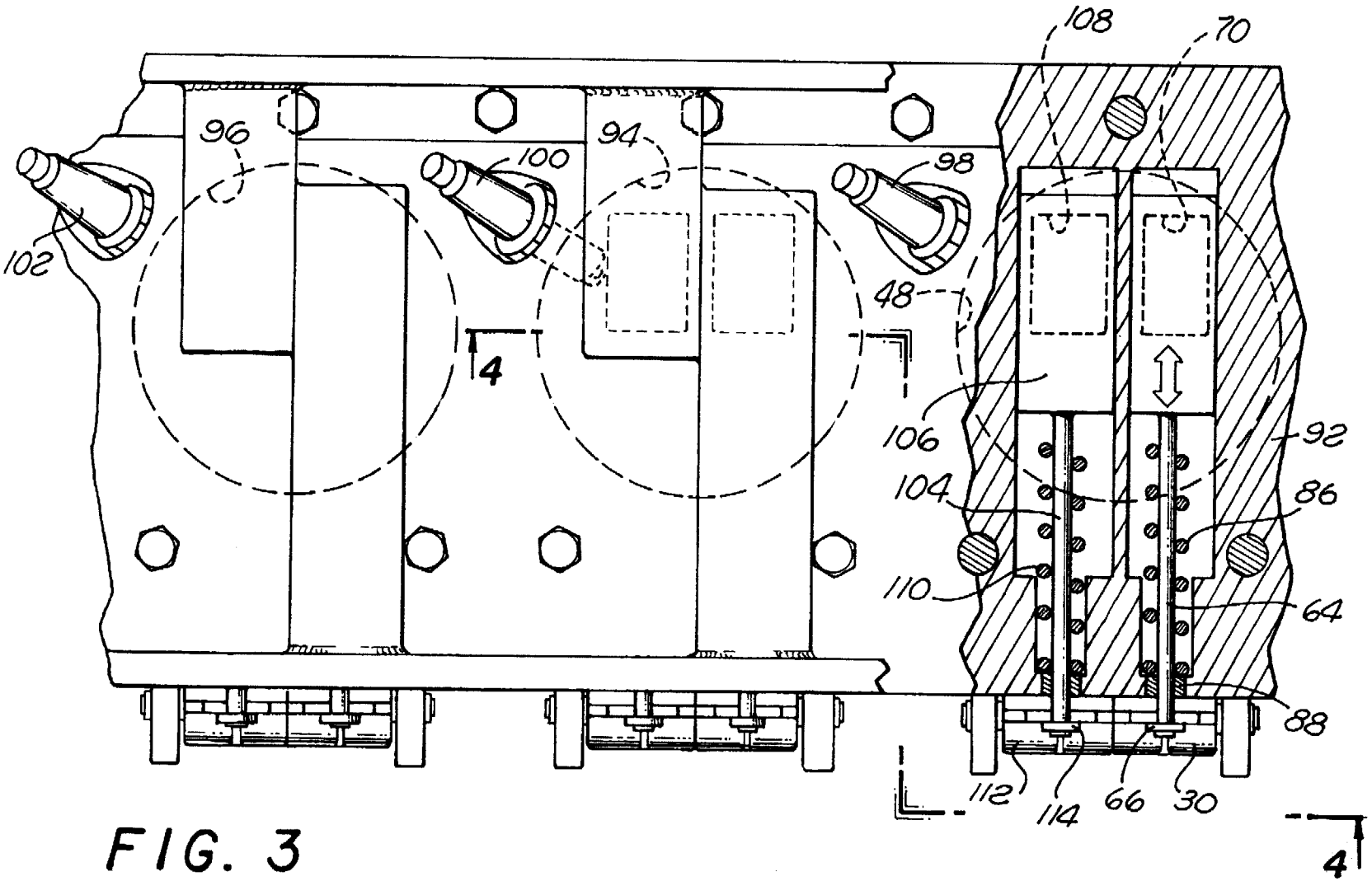
FIG. 3 is a sectional view taken at line 3—3 of FIG. 2.

FIG. 3 is a top plan view of the engine 10, partially broken away, taken generally on line 3—3 of FIG. 2. One may observe three in-line cylinders defined by cylinder walls 48, 94 and 96. Spark plugs 98, 100 and 102 extend within the cylinders 48, 94 and 96 respectively, providing the high-voltage spark for igniting compressed fuel-air mixtures within each cylinder.

Referring specifically to the cylinder 48, one can see that the intake valve comprising valve rod 64 and valve head 68 which regulates the flow of combustion gases through the inlet aperture 70 is positioned side-by-side next to a similar exhaust valve comprising a valve shaft 104 fixed to the rear of a slidable valve head 106. Such exhaust valve shutters the flow of exhaust gases through an aperture 108 to interrupt and regulate flow from the cylinder into the exhaust port 34.

As in the case of the inlet valve, a spring 110 surrounds the rear shaft 104 of the exhaust valve, biasing it to the closed position. A rocker arm 112, engaged to the rear of the valve shaft 104 by means of a fastener 114, is provided for opening and closing the exhaust valve.

FIG. 4 is a side elevation view of a portion of the engine 10, partially in section, taken at line 4—4 of FIG. 3. This view juxtaposes and therefore provides parallel views (one in section, the other an exterior) of the adjacent cylinders defined by the cylinder walls 48 and 94. As mentioned earlier, the push rod 28 is actuated by the abutting cam lobe 42 fixed to the camshaft 26. The adjacent cam 116 similarly abuts a push rod 118 which, in turn, actuates the rocker arm 112 that is fixed to the rod 104 and forms the rear portion of the sliding exhaust valve. The adjacent cam lobes 42 and 116 are appropriately eccentrically shaped so that the abutting push rods 28 and 118 respectively are actuated in a timed relationship whereby the respective inlet and outlet apertures are opened and closed in accordance with the requirements of four-stroke engine operation. The design of a camshaft for affecting appropriate sequential operation of valves is well-known to those skilled in the art.

While this description has proceeded with reference to the operation of a single cylinder incorporating the teachings of the invention, the extension of the operation of the sliding valves to, for example, a six or eight cylinder engine is a direct extension of the same type of phasing for extending an internal combustion engine fitted with poppet-type valves to multiple cylinders.

By employing sliding valves in accordance with the invention, one may realize numerous advantages. As opposed to valves that must extend within a cylinder, those of the present invention operate under much less extreme temperature conditions (approximately 160 to 200 degrees Fahrenheit, the operating temperature of a standard engine block), resulting in extended life. The sliding valves of the invention leave the inlet and exhaust ports entirely clear during the appropriate phases of the four-stroke cycle. Not even a partial obstruction occurs when a sliding valve is open, improving efficiency as a higher degree of combustion is obtained and particulate and pollutant emissions thereby reduced.

While this invention has been described with reference to its presently preferred embodiment, it is not limited thereto. Rather, this invention is limited only insofar as it is described as defined by the following set of patent claims and includes within its scope all equivalents thereof.

What is claimed is:

1. In an internal combustion engine of the type in which a plurality of pistons reciprocate within a plurality of cylinders over a repeating four-stroke cycle, each of said cylinders including an inlet port for admitting an air-fuel mixture during an intake stroke and an exhaust port for evacuating combustion gases during an exhaust stroke, valves for controlling flows through each of said ports and said reciprocating motions of said pistons are driven by a rotatable crankshaft, the improvement comprising, in combination:

a) external valve seats being associated with the inlet port and the exhaust port of each of said cylinders;

b) each of said valves including a substantially-planar valve head and a rod fixed to said valve head;

c) a spring encircling said valve rod, said spring being arranged to exert a continual linear force upon said valve head to urge said valve head in a first direction toward said valve seat;

d) a rocker arm responsive to rotation of said crankshaft and engaged to the end of said valve rod remote from said head for periodically exerting a linear force upon said valve head to urge from said valve head in the opposite direction.

2. An internal combustion engine as defined in claim 1 further characterized in that:

a) each of said valves is substantially horizontal;

b) the top surface of each of said valve heads is inclined; and c) said valve seat is tapered to match said valve.

3. An internal combustion engine as defined in claim 2 wherein said valve seat further comprises;

a) a first tapered section;

b) a second tapered section; and c) said first and second tapered sections are at opposite sides of said port.

4. An internal combustion engine as defined in claim 3 wherein the lower surface of said valve comprises a coating of preselected material.

5. An internal combustion engine as defined in claim 4 wherein said coating is TEFLON.

6. An internal combustion engine as defined in claim 4 wherein said coating comprises graphite.

7. An internal combustion engine as defined in claim 4 wherein said coating comprises a composite of graphite and titanium.

* * * * *